United States Patent [19]

Hay, II

[11] Patent Number: 4,647,213

[45] Date of Patent: Mar. 3, 1987

[54] WASTE DISPOSAL APPARATUS

[75] Inventor: Robert A. Hay, II, Midland, Mich.

[73] Assignee: The Dow Chemical Company, Midland, Mich.

[21] Appl. No.: 144,471

[22] Filed: Apr. 28, 1980

Related U.S. Application Data

[63] Continuation of Ser. No. 892,050, Mar. 31, 1978, abandoned.

[51] Int. Cl.[4] ..... B01F 7/18; B01F 15/00

[52] U.S. Cl. ..... 366/199; 222/108; 250/506.1; 252/628; 252/633; 366/286; 366/347; 366/349

[58] Field of Search ..... 252/301.1 W, 626, 631, 252/633, 628; 250/506, 507, 517, 435, 431; 222/108; 366/199, 174, 159, 286, 347, 349

[56] References Cited

U.S. PATENT DOCUMENTS

| | | | |
|---|---|---|---|
| 3,940,628 | 2/1976 | Stock | 252/301.1 W |
| 3,971,732 | 7/1976 | Meier | 252/301.1 W |
| 4,010,108 | 3/1977 | Gablin | 252/301.1 W |
| 4,056,362 | 11/1977 | Gablin et al. | 252/301.1 W |
| 4,065,400 | 12/1977 | Bjorklund | 252/301.1 W |

FOREIGN PATENT DOCUMENTS

| | | | |
|---|---|---|---|
| 2421142 | 11/1975 | Fed. Rep. of Germany | 250/517 |
| 1520681 | 4/1968 | France . | |

*Primary Examiner*—John F. Terapane
*Assistant Examiner*—Howard J. Locker
*Attorney, Agent, or Firm*—B. M. Kanuch; R. B. Ingraham

[57] ABSTRACT

A waste disposal mixer is shown suitable for the encapsulation of radioactive wastes in synthetic resins. The mixer permits the selective discarding of the agitator member and of a drip pan selectively positionable to receive dripping material from the agitator. The agitator can be selectively replaced, all movements being controlled remotely.

12 Claims, 21 Drawing Figures

WASTE DISPOSAL APPARATUS

This is a continuation of application Ser. No. 892,050, filed Mar. 31, 1978, abandoned.

CROSS-REFERENCE TO RELATED APPLICATION

A number of pieces of apparatus have been devised for the encapsulation of radioactive waste materials within a hardenable matrix. Radioactive wastes have been encapsulated in tar-like substances by milling or malaxating the waste with a hardenable material such as a tar. Other apparatus has been provided for the encapsulation of radioactive wastes by admixing the waste material with urea-formaldehyde resin, discharging the mixture of resin and waste into a container and permitting the urea-formaldehyde resin to harden. In addition to premixing waste and resin in a static mixing device prior to contact of the mixed waste material with the container or disposal drum in which it will harden, it is also known to further mix the resin and waste material in a drum by means of a blade-type agitator which is disconnected from its drive shaft and left in the drum. In the disposal of radioactive material, generally the mixing equipment becomes contaminated to a greater or lesser extent by minor amounts of hardened resin containing radioactive material. Such a situation is almost impossible to prevent when the hardenable material is catalyzed and mixed in a device other than the ultimate container in which the hardened material will be buried or otherwise disposed of. If the equipment employed for the admixture of a resin and radioactive waste becomes contaminated with hardened resin containing radioactive waste, cleaning is oftentimes time-consuming, expensive and difficult.

It would be desirable if there were available an improved apparatus for the admixture of radioactive waste materials with a hardened resin.

It would also be desirable if such an apparatus would permit mixing of waste and hardenable resin in a container which will accompany the hardened material to a disposal site.

It would also be desirable if there were available such a mixing apparatus which would permit the disposal and replacement of materials which become contaminated with resin-encapsulated radioactive waste.

These features and other advantages in accordance with the present invention are achieved in a mixing apparatus, the mixing apparatus having in cooperative combination a frame, a conveyor adapted to convey an open-topped container to receive resin and radioactive waste, a container positioning means adapted to locate an open-topped container at a predetermined location on the conveyor, an agitator assembly reciprocally mounted on the frame, the agitator assembly comprising agitator drive means, an agitator demountably affixed to the drive means, the agitator being selectively positionable so that the agitator extends at least partially into a container held by the container locating means, means to connect and disconnect the agitator from the agitator drive means, means to selectively position an agitator adjacent the agitator drive means and connect said agitator to the drive means, a drip-receiving assembly, the drip-receiving assembly having a drip pan support means selectively positionable beneath the agitator assembly when the agitator assembly is exposed externally to a container, the drip-receiving means being selectively positionable beneath the agitator assembly and remote therefrom, the drip-receiving assembly being adapted to carry a drip-receiving member and selectively discarding the drip-receiving member into an open-topped container positioned by a container-positioning means and means to supply a drip-receiving member and position said drip-receiving member on said drip-receiving means.

Further features and advantages of the present invention will become more apparent from the following specification taken in connection with the drawing wherein.

Figure 1:
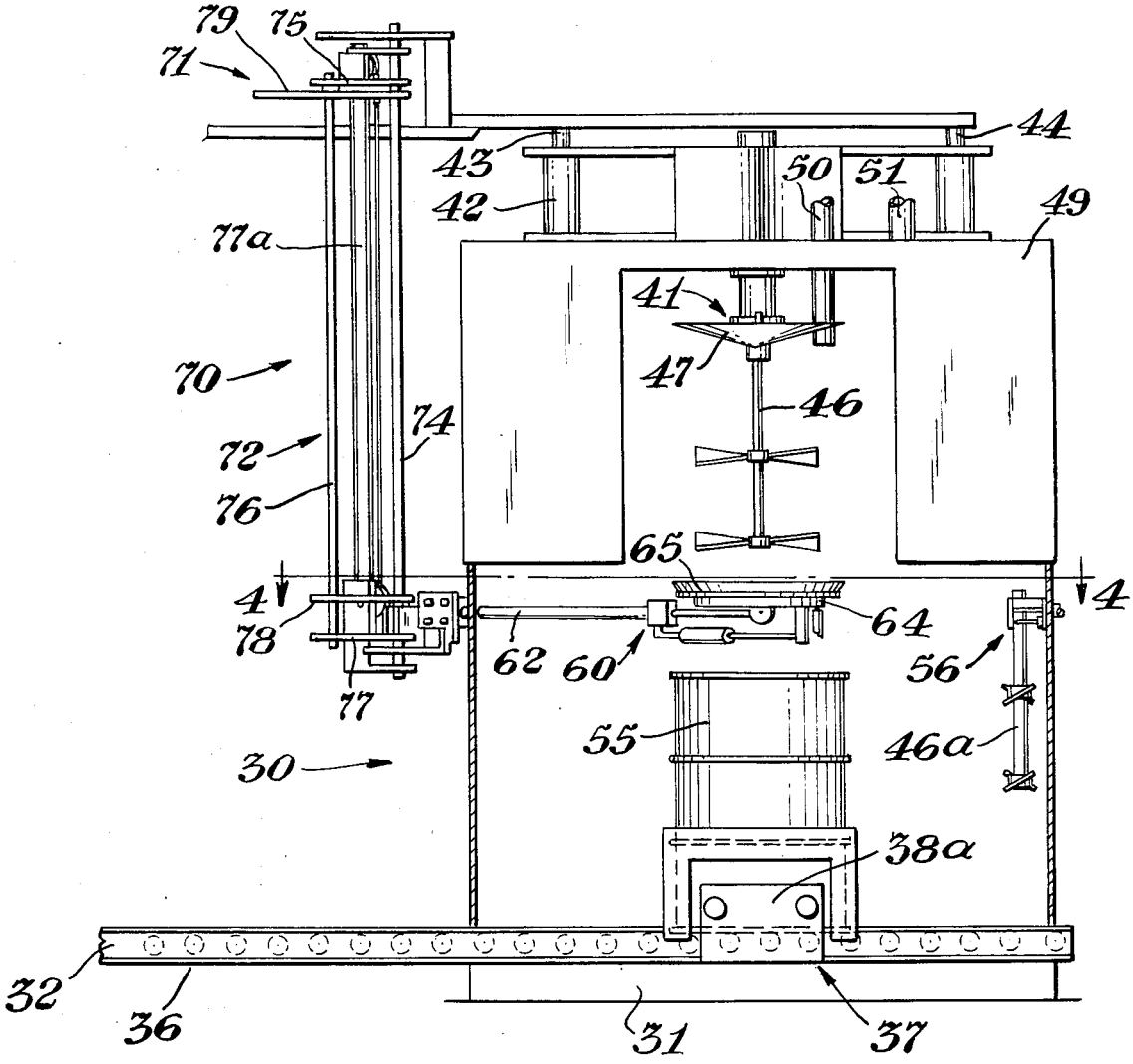
FIG. 1 is a schematic side view of a mixing apparatus in accordance with the invention.
Figure 3:
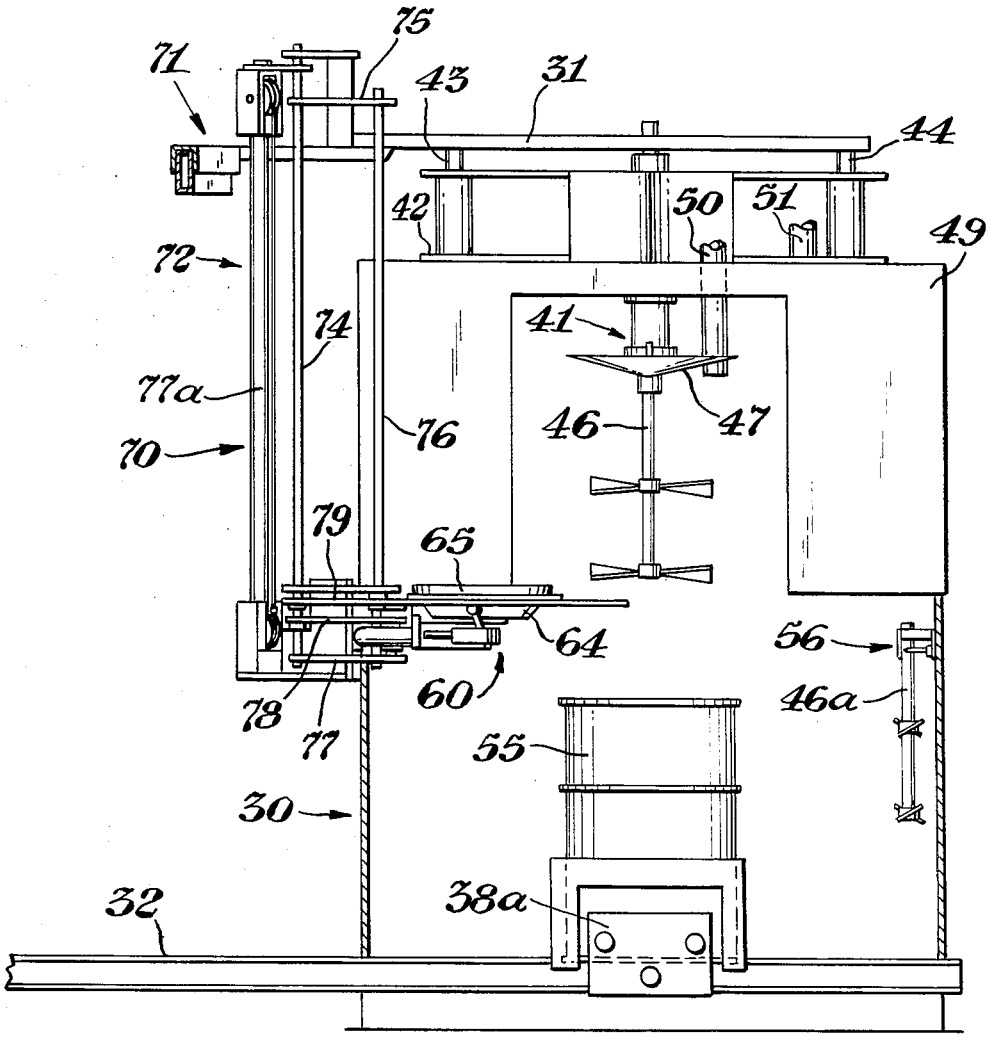
FIG. 3 is a side view of the apparatus of FIG. 1 with drip pan positioning means in a different position.
Figure 5:
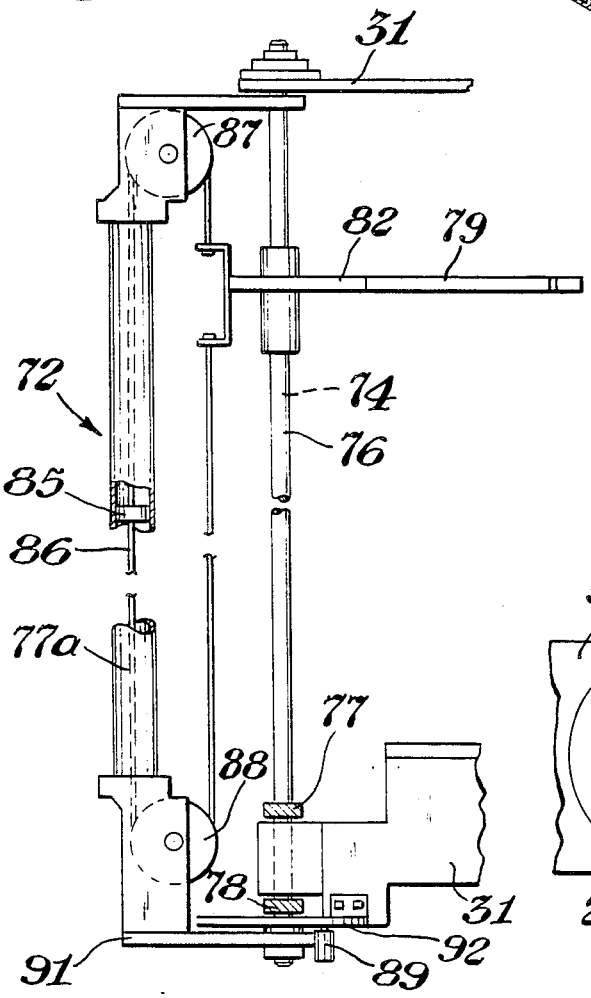
FIG. 5 is a simplified representation of drip pan supply and positioning means.
Figure 8:
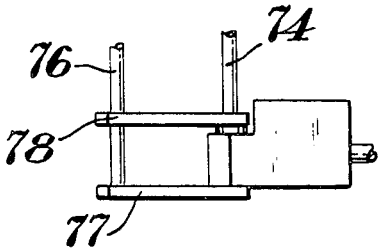
Figure 21:
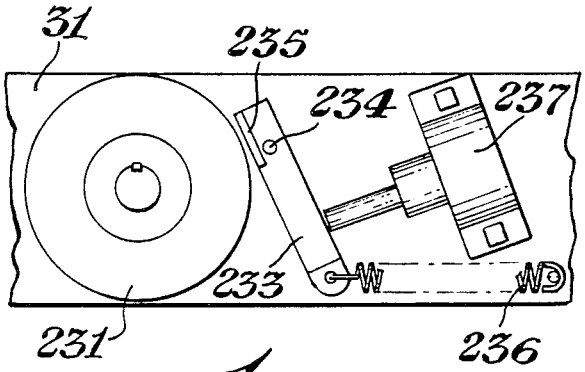
Figure 12:
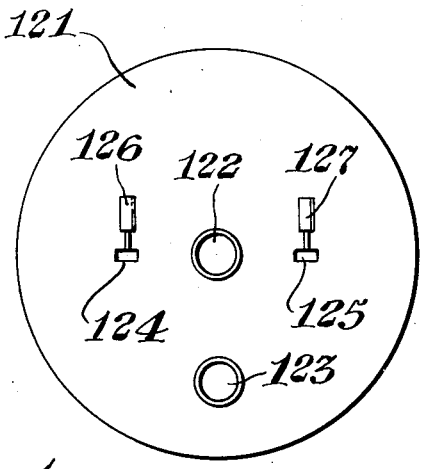
Figure 13:
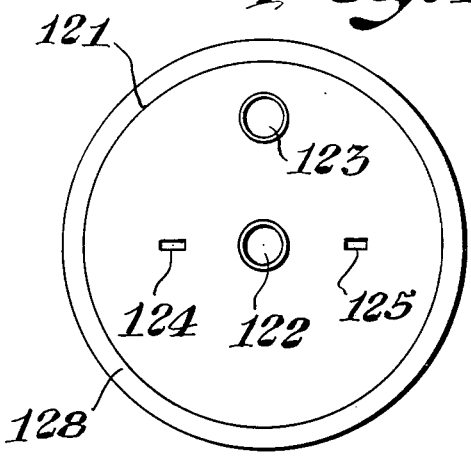
Figure 14:
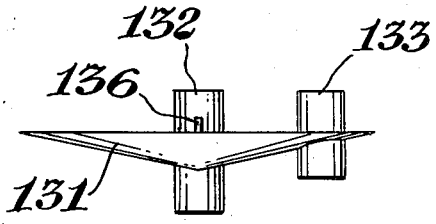
Figure 11:
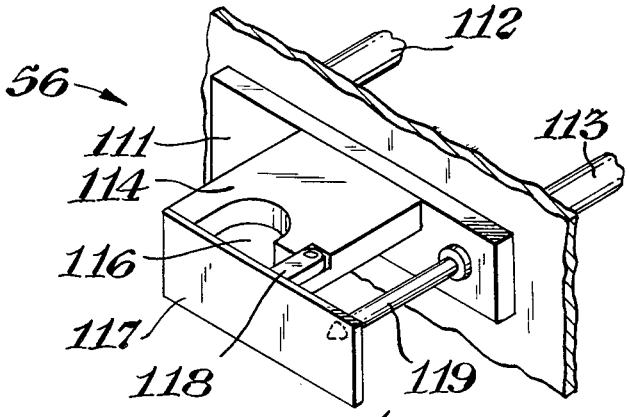
Figure 15:
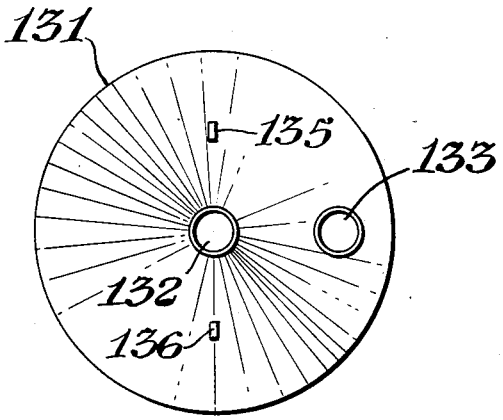
Figure 9:
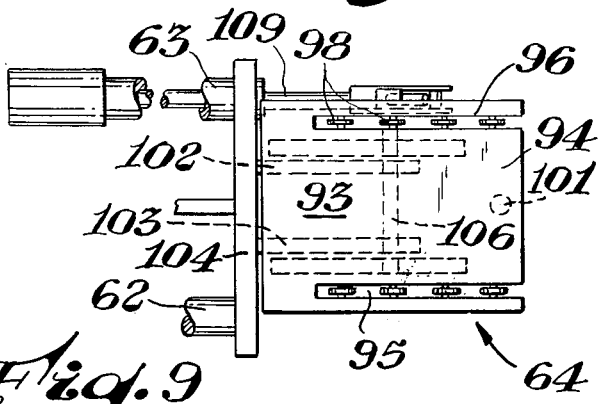
Figure 10:
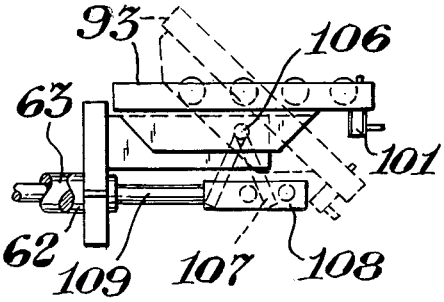
Figure 16:
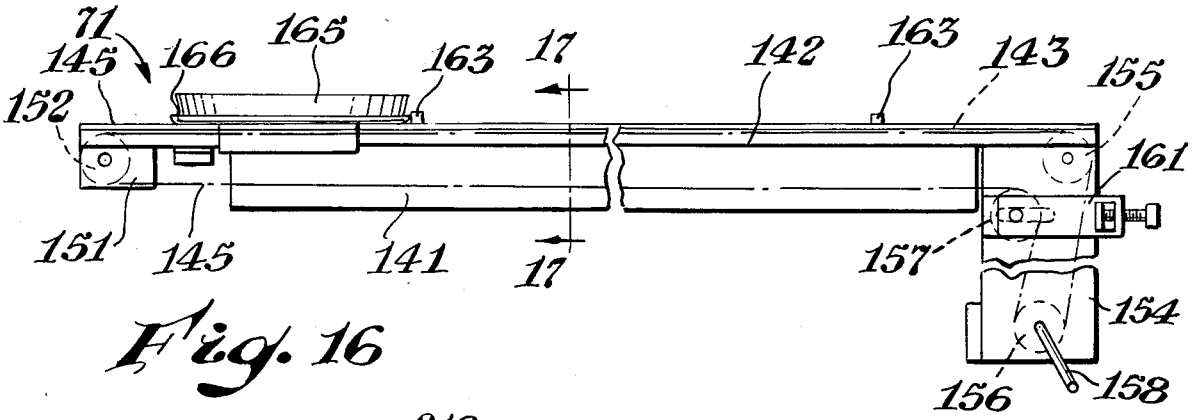
Figure 19:
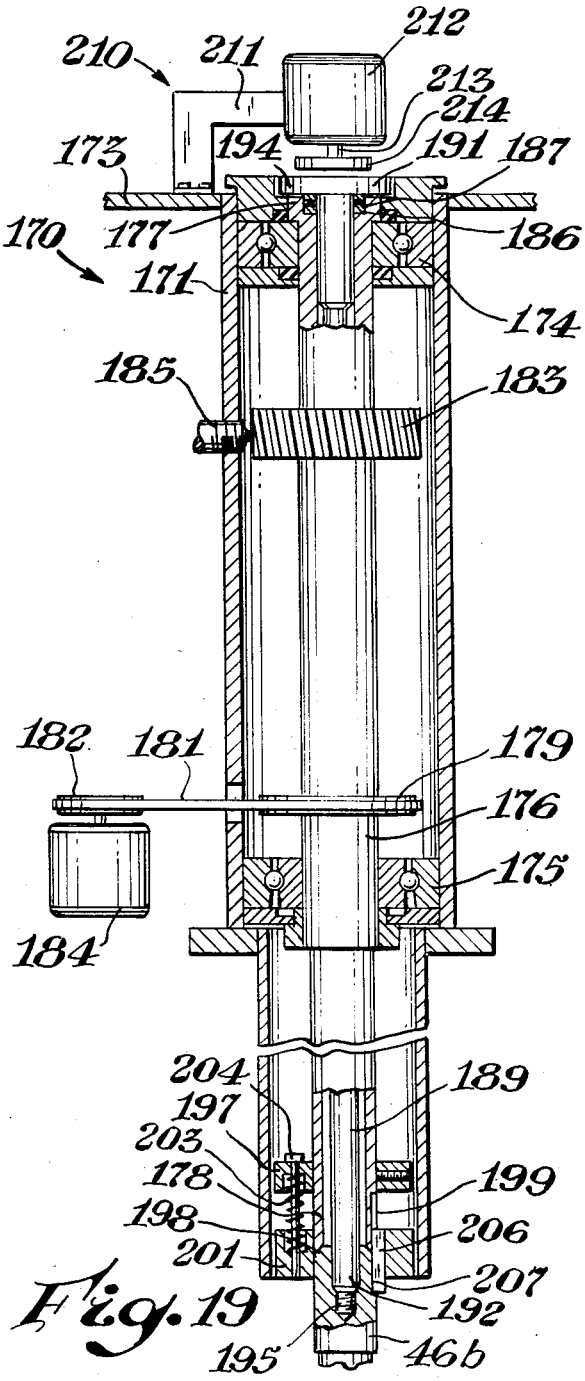
Figure 17:
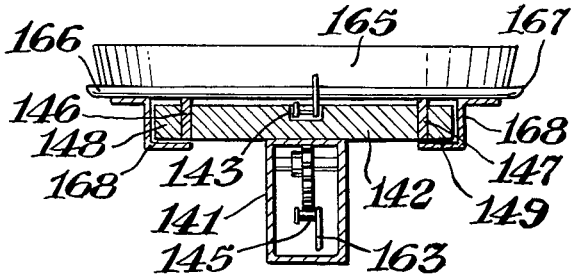
Figure 18:
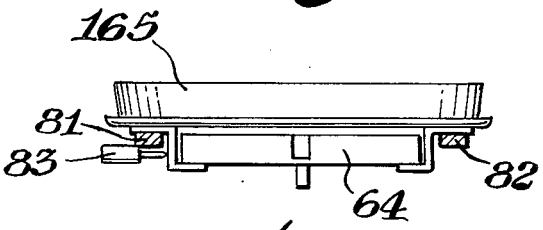
Figure 20:
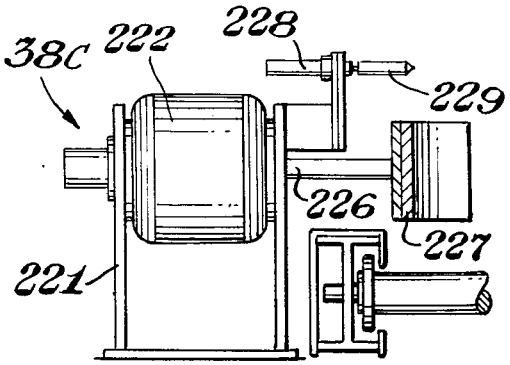

FIG. 8 schematically depicts the mounting of the apparatus of FIG. 5;

FIG. 9 is a top view of a drip pan positioning means;

FIG. 10 is a side view of the drip pan positioning means of FIG. 9;

FIG. 11 is a fractional representation of the agitator positioning means;

FIG. 12 is a top view of a splash guard mount employed in the apparatus of FIG, 1;

FIG. 13 is a bottom view of the mount of FIG. 12;

FIG. 14 is a side view of a splash guard for use with the guard mount of FIG. 12;

FIG. 15 is a top view of the splash guard of FIG. 14;

FIG. 16 is a side view of a drip pan conveyor;

FIG. 17 is a sectional view of the conveyor of FIG. 16 taken along the line 17—17;

FIG. 18 depicts the positioning of drip pan support elements when the apparatus is in the configuration generally depicted in FIG. 3;

FIG. 19 depicts the agitator drive assembly of the apparatus of FIG. 1;

FIG. 20 is a schematic representation of one-half of the container positioning means; and FIG. 21 depicts an arrangement of an elevating screw brake.

Figure 2:
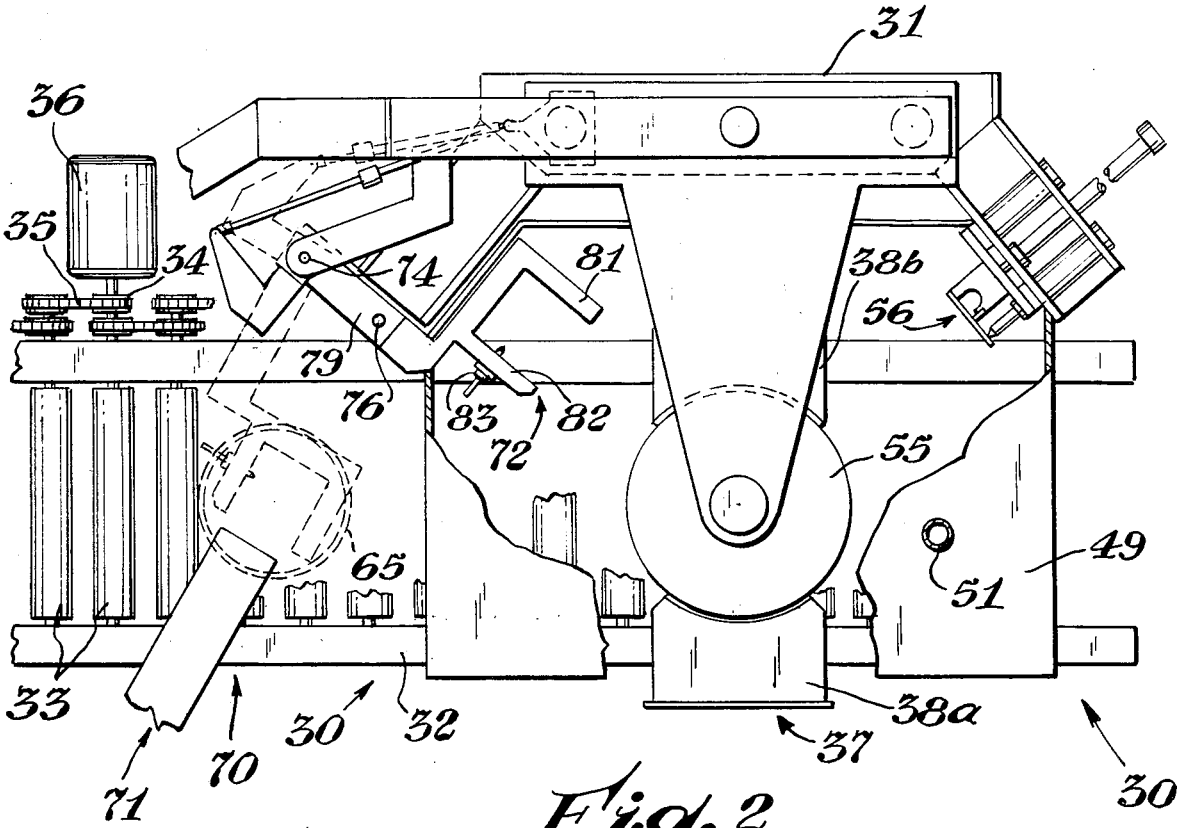
FIG. 2 is a schematic partial and partially cut-away view of the apparatus of FIG. 1.
Figure 4:
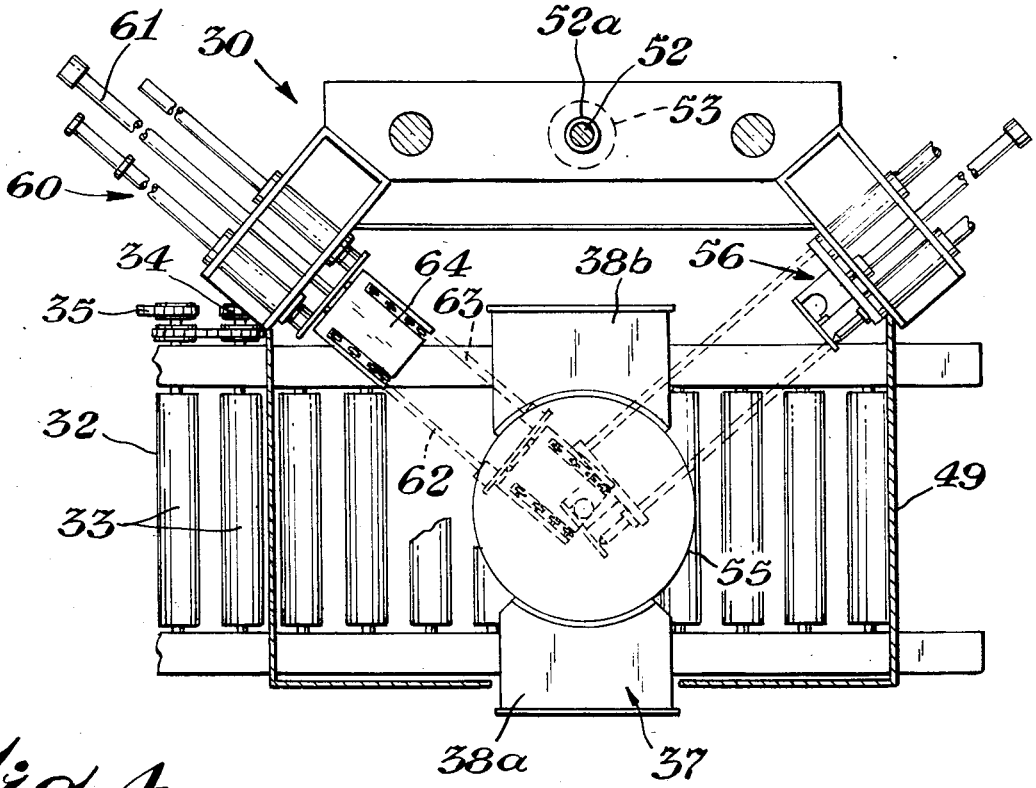
FIG. 4 is a schematic sectional representation of the apparatus of FIG. 1 taken along the line 4—4 thereof.

In FIGS. 1 through 4 there is schematically represented a mixing apparatus in accordance with the present invention generally designated by the reference numeral 30. The apparatus 30 comprises in cooperative combination a frame 31 having in association therewith a container conveyor 32. The conveyor 32 has a plurality of generally parallel rolls 33. Each of the rolls 33 has affixed thereto a pair of chain sprocket gears 34. Adjacent pairs of chain sprocket gears 34 are connected to the roller chains 35. One of the rolls 33 is connected to a motor 36. The conveyor 32, thus, permits the selective positioning of an article such as a container along its length by appropriate rotation of the rolls 33. A container positioning means 37 comprises a first portion **38*a* and a second oppositely-disposed portion 38*b*. The portions 38*a* and 38*b* are of generally identical configuration and as depicted in FIG. 2 are disposed on opposite sides of the conveyor 32 and have movable curved faces adapted to engage a drum or other desirable container therebetween. The apparatus 30 has an agitator assembly 41. The agitator assembly 41 is supported by a carriage 42 which is slidably mounted on ways 43 and 44 which extend generally vertically between the lowermost and uppermost portions of the frame 31. The agitator 41 has demountably affixed thereto an agitator 46 and a demountable splash guard 47. The carriage 42 defines a hood 49 generally surrounding the sides and agitator on sides and top. The hood 49 has a conduit 50 and a gas exit conduit 51. The carriage 42 is positioned on ways 43 and 44 by means of an elevating screw such as the screw 52 and a corresponding ball nut 52***a* affixed to the carriage 42. The screw 52 is selectively rotated in either direction by means of a hydraulic motor 53, thus, permitting the carriage 42 to be located in its uppermost position as shown in FIGS. 1 and 3 or disposed generally adjacent the conveyor and positioning agitator 46 within an open-topped container 55 disposed on the conveyor 32 between the container positioning means portions 38*a* and 38*b*. Beneficially the screw 52 is provided with a brake mechanism such as is depicted in FIG. 21 to assure lack of movement of the carriage. An agitator holding positioning means 56 is affixed to the frame 31 at a location below and to one side of the agitator 46. The positioning means 56 has clamped therein a replacement agitator 46*a*. As is illustrated by one of the dotted representations in FIG. 4, the positioning means can position the agitator to a location which is approximately centered on the drum 55 which in turn is coaxial with the agitator 46. Also supported on the frame 31 is a drip-catching assembly generally designated by the reference numeral 60. The drip-catching assembly comprises a lateral drip pan positioner 61 comprising a hydraulic cylinder, first and second bearing bars 62 and 63 slidably mounted within the frame 31, a pan support 64 affixed to the bearing bars 62 and 63, the bearing bars 62 and 63 being hollow, the pan support 64 having disposed thereon a drip-receiving means or disposable drip pan 65, the support 64 being tiltable to cause the drip pan 65 to fall into the container 55. Also supported by the frame 31 is a drip pan supply means generally designated by the reference numeral 70. The drip pan supply means 70 comprises a drip pan conveyor partially shown and designated by the reference numeral 71 and a drip pan elevator and positioning mechanism generally designated by the reference numeral 72. The drip pan elevator comprises a first elevator way 74 which extends generally parallel to the agitator 46. The way 74 is pivotally attached to the frame 31. Supported on the way 74 is a first spacing arm 75 which in turn carries a second way 76. The ways 74 and 76 are maintained in fixed spaced relationship by means of arm 77 and arm 78 remote from the spacing member 75. Also supported on way 74 is a linear actuator 77*a*. Beneficially, the linear actuator is a so-called cable cylinder, a pneumatic cylinder having a piston therein, plastic-coated cable attached to the piston, the cable passing through seals at each end of the cylinder thereby providing a traverse approximating the length of the cylinder. Slidably supported on the ways 74 and 76 is a drip pan positioning fork 79, the fork 79 extending generally perpendicular to the ways 74 and 76. The fork 79 has tines 81 and 82 outwardly projecting from the ways 74 and 76. Supported on tine 82 is a drip pan locking means 83. Beneficially, the locking means 83 is a small short-throw pneumatic cylinder which clamps the drip pan to fork 79. Beneficially, the shaft of the cylinder engaging the drip pan is finished with a conical point. In FIGS. 1 and 2, the fork 79 is shown in its uppermost position and positioned remote from the agitator 46. In FIG. 3 and in FIG. 2, the fork 79 is shown in the drip pan delivery position, that is, in its lowermost position on the ways 74 and 76. The tines 81 and 82 define a space therebetween into which the drip pan support 64 may be selectively positioned.

Figure 6:
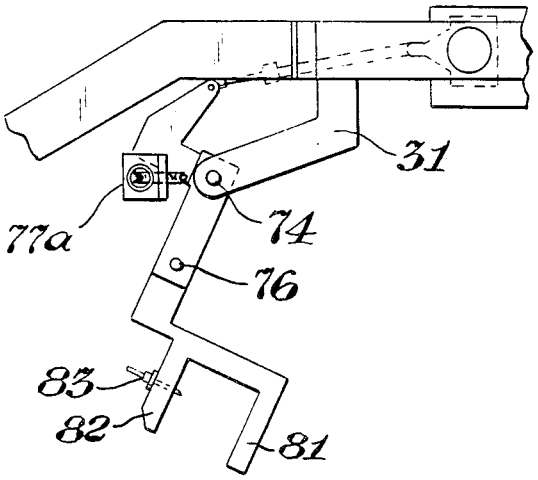
FIG. 6 is a partial top view of the apparatus of FIG. 5.

In FIGS. 5 and 6, fractional views of the positioning mechanism 72 are shown wherein the cable cylinder 77*a* is partially cut-away to show piston 85, cable 86 and pulleys 87 and 88 disposed at either end thereof. The fork 79 is affixed to each end of the cable 86 of the cylinder 77*a*. A small pneumatic cylinder 89 affixed to a lower cylinder bracket 91 engages detents within bracket 92 affixed to frame 31 to provide indexing stops for the rotation of the drip pan positioning means 72 about the axis of way 74 and, thus, assuring alignment of fork 79 with the conveyor 71 when the fork 79 is in the uppermost position and in alignment with the drip pan 64 when the fork 79 is in the lowermost position and pivoted toward the agitator 46.

Figure 7:
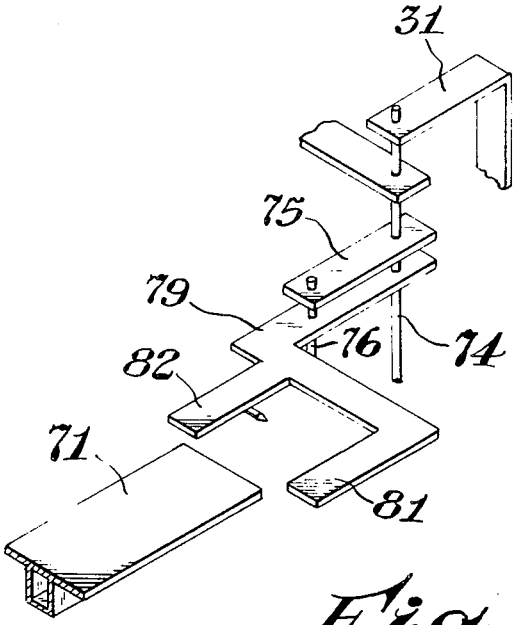
FIG. 7 is a fractional isometric view of a portion of the apparatus of FIG. 5.

FIG. 7 serves to clarify the supported arrangement of the fork 79 on the ways 74 and 76.

FIG. 8 schematically depicts the support arrangement at the lower portion of the drip pan positioning means.

FIGS. 9 and 10 are schematic detailed views of the drip pan support 64. The support 64 comprises a table 93 which has an upper or pan-supporting surface 94, a pair of slots 95 and 96 disposed within the table 93 and extending in a direction generally parallel to the support members 62 and 63. In each of the slots 95 and 96 are disposed rollers 98 which project upwardly from the surface 94. The rollers 98 have their axes normal to the longitudinal axis of supports 62 and 63 and the axes of the rollers 98 lie in a plane generally parallel to the surface 94. A pneumatic cylinder 101 is affixed to the table 93. The cylinder 101 is generally normal to and disposed from the surface 94. Selectively, the piston thereof can engage or disengage from a drip pan disposed on the surface of the table. The table 93 is pivotally supported by brackets 102 and 103 which in turn are affixed to a connecting plate 104 to which are rigidly affixed supports 62 and 63. The table 93 is pivotally affixed to the supports 102 and 103 by means of a shaft 106. Shaft 106 has dependent therefrom an arm 107. The arm 107 engages a terminal end 108 of piston rod 109 which selectively permits the table 93 to be pivoted from a horizontal position to a position about 45° from the horizontal.

In FIG. 11 there is depicted a view of the agitator positioning means generally designated by the reference numeral 56. The agitator positioning means 56 comprises a head or support block 111 slidably supported by a first piston rod 112 and a second hollow way 113. An agitator-receiving yoke 114 is affixed to the block 111. An agitator-receiving cavity 116 having a generally U-shaped configuration is disposed in the yoke 114 remote from the block 111. A clamp bar 117 is pivotally affixed to the yoke 114 at location 118 and is selectively maintained in the position as depicted in FIG. 11 by piston rod 119 in engagement with bar 117. On retraction of the piston rod 119, bar 117 pivots to permit exit or entry of an agitator shaft.

In FIG. 12, there is depicted a top view of the fixed first portion of the splash guard 47, the fixed or uppermost portion being indicated by the reference numeral 121. The portion 121 is a sheet metal disk having a central opening 122 through which the shaft of the agitator 46 passes. A second generally peripheral opening 123 is provided through which waste is added to the drum. The portion 121 defines diametrically opposed and radially disposed slots 124 and 125 passing entirely through portion 121. Adjacent each slot is a latching means 126 and 127, respectively. The latching means beneficially are small pneumatic cylinders.

FIG. 13 depicts a bottom view of the splash guard portion 121. A resilient annular sealing means 128 is disposed about the periphery of the portion 121. The sealing means 128 is adapted to engage an open end of a container such as the container 55.

FIGS. 14 and 15 are side and bottom views, respectively, of a second or disposable splash guard portion designated by the reference numeral 131. The splash guard portion 131 has a generally conical configuration, a first or centrally disposed conduit 132 and a second generally circumferentially disposed conduit 133. The splash guard 131 has a generally conical configuration and beneficially is prepared from a sheet material such as thin sheet steel or the like. Two lugs 135 and 136 extend upwardly from the concave surface of the guard 131. The lugs 135 and 136 are adapted to pass through openings 124 and 125 of the guard portion 121 and then selectively be retained therein by the locking devices such as pneumatic cylinders 126. The lugs 135 and 136 and locking devices 126 provide a means for selectively connecting and disconnecting. In operation, the shaft of the impeller agitator 46 passes through the conduit 132 and appropriate holes or pipe for delivery of radioactive waste and if desired encapsulating components pass through the conduit 133. When the contamination of the portion 131 has occured to an undesirable degree, latching devices 126 release the locking tabs 135 and 136 and the splash guard portion is dropped into a container such as the container 55.

In FIG. 16, there is depicted a shortened side view of a drip pan conveyor generally designated by the reference numeral 71. The conveyor 71 has a frame 141, beneficially having a configuration of a box beam and a track member 142 affixed thereto. The track member 142 defines therein a generally centrally disposed groove 143 in which there is disposed a pan engaging means or roller chain 145. The track member 142 has affixed thereto first and second antifriction members 146 and 147 which protrude upwardly from the surface of the track member and provide a low friction bearing for a drip pan sliding thereon. The antifriction members 146 and 147 are affixed to the track member 142 by elongate clamp members 148 and 149. The conveyor 71 has a discharge end 151 having disposed therein a roller chain sprocket 152. Remotely disposed from sprocket 152 and conveyor first end 154 is a second sprocket 155 and a driving sprocket 156, an idler or tension sprocket 157. The driving sprocket 156 has a rotating means or handle 158. The tension sprocket 157 is rotatably supported in an adjustable yoke 161. The roller chain 145 engages all the sprockets and is provided with, in spaced-apart relationship, a plurality of pan-engaging links designated by the reference numeral 163. Disposed on the conveyor 71 is a drip pan 165. The drip pan 165, as depicted in FIGS. 16 and 17, has a low upwardly flaring generally frustoconical configuration and the frustoconical portion is supported on a generally circular base 166 having an upturned edge portion or rim 167. Affixed to the base 166 and remote from the frustoconical configuration are two generally L-shaped flanges designated by the reference numeral 168. The flanges 168 are of identical configuration and are oppositely disposed to each other and the legs of the "L" projecting toward each other. Such an arrangement of the flanges 168 prevents any significant sideways motion of the pan 165 as it is moved along the conveyor 71 by rotation of the handle 158 under the force applied by the projections 163.

In FIG. 18 there is a schematic representation of the relationship between the tines 81 and 82 of the fork 79 and a drip pan carrier 64 equivalent to the assembly depicted in FIGS. 9 and 19 with a drip pan 165.

In FIG. 19 there is schematically depicted a partly-in-section view of an agitator drive assembly generally equivalent to the assembly 41 of FIG. 1 and indicated by the reference numeral 170. The assembly 170 comprises a generally cylindrical spindle housing 171 affixed to a frame 173 which is equivalent to the carriage 42 of FIGS. 1, 2, 3 and 4. The spindle housing 171 has a generally hollow cylindrical configuration and has disposed therein a first or upper spindle bearing 174 and a second or lower spindle bearing 175. Supported by the bearings 174 and 175 is a rotatable hollow spindle 176, the spindle having an upper end 177 and a lower end 178. A drive pulley 179 is rigidly affixed to the spindle 176 about midway between the ends 177 and 178. A drive belt 181 is in engagement with pulley 179 and with a pulley 182 which is supported by driving motor 184. Beneficially, the motor 184 is a pneumatic motor. Generally adjacent the pulley 179 is a gear 183 and a sensor or transducer 185 which is employed to determine the speed of the rotation of the spindle 176. At the first end 177 of spindle 176 is disposed an annular recess 186. In recess 186 is disposed a bearing 187. A draw bar 189 is disposed partially within the bearing 187 and extends the entire length of the spindle 176. The draw bar 189 has a first end 191 and a second end 192. A disk 194 is affixed to the first end 191 of draw bar 189 and is generally co-axially disposed thereto. At the second end 192 of the draw bar 189, the draw bar defines external screw threads 195. A collar 197 is rigidly affixed to the spindle 176 adjacent the second end 178. The spindle 176 at second end 178 terminates in an outwardly flaring generally frustoconical face 198. A generally axially-extending slot 199 is formed at second end 178 of spindle 176. A sliding collar 201 is resiliently supported by collar 197 and tensioned away therefrom by means of spring 203 surrounding a bolt 204 which limits the distance that collars 197 and 201 may be separated. Collar 201 has rigidly affixed therein a key 206 which engages the key seat or slot 199 of the second end 178 of spindle 176. An agitator shaft **46*b* is depicted in engagement with the outwardly flaring terminal portion 198 of spindle 176. Agitator shaft 46*b* defines an axially-extending keyway or recess 207 which also is adapted to receive a portion of the key 206 in collar 201. A brake means 210 is affixed to frame 173 adjacent the first end 177 of the spindle 176. The brake means comprises a bracket 211, a linear actuator 212 such as a pneumatic cylinder. The linear actuator has a shaft 213 having affixed thereto a brake pad 214. The actuator 212 is adapted to position the pad 214 either remote from or in contact with the disk 194 affixed to the draw bar 189. Thus, when it is desired to disengage the agitator, rotation of the draw bar 189 is prevented by the brake 210. The spindle is rotated to unscrew the threaded portion 195 of the draw bar and the agitator then may drop into the container position beneath the spindle assembly. When it is desired to replace the agitator, the agitator is positioned beneath the spindle being held in agitator position means such as means 56 of FIGS. 1, 2, 3, 4 and 11, the spindle lowered onto the agitator, the spindle rotated and moved downwardly until key 206 engages slot 207 and by rotating spindle and agitator in the appropriate direction while maintaining the draw bar 189** stationary, the agitator is replaced.

In FIG. 20, there is a side view of one-half of a container locater generally designated by the reference numeral 38*c*. The container locater or positioner 38*c* comprises a frame 221 having supported therein a linear actuator 222. The linear actuator 222, as depicted, is a pneumatic cylinder having an actuator shaft 226. The actuator shaft remote from the frame 221 carries a shoe 227 suitable to engage and position a container. As depicted in the drawing, the shoe is arcuate and particularly suited to engage a container such as a steel drum. The specific shape of the shoe will of course depend on the shape of the container employed to receive waste. Adjacent the shoe 227, frame 221 supports a linear actuator 228 such as a pneumatic cylinder. On the piston of the cylinder 228 is disposed a metal point 229 adapted to engage a metal container and assure electric grounding thereof.

FIG. 21 depicts a view of elevating mechanism brake affixed to the frame 31. Affixed to the screw 52 is a brake drum 231. A brake lever 233 is pivoted about pivot 234. The brake arm 233 has a brake face 235. A spring 236 tensions the face 235 toward the drum 231. A linear actuator such as a pneumatic cylinder 237, when actuated to overcome the force of the spring 236, disengages the brake face 235 from the drum 231. Beneficially, the brake and motor 53 are actuated simultaneously, the brake preventing rotation of the screw 52 and motion of the carriage 42 when motive fluid is not being supplied to motor 53.

In operation of the apparatus in accordance with the present invention, a container such as the container 55 is moved by the conveyor 32 between the positioning or locating means 38*a* and 38*b* with the carriage in the raised position as depicted in FIG. 1 and the drip pan support 64 retracted, that, is, positioned remote from the agitator 46. The container engaging means, such as 38, serves to position the container or drum 55 generally coaxially with respect to the agitator 46. Power is applied to the motor 53 to lower the carriage 42 and partially dispose the agitator 46 within the drum 55. The drum 55 may be empty or may contain a portion of the encapsulating resin. Waste and activator with or without resin are added through conduit 50. Power is applied to to the agitator 46 and the contents mixed to a desired degree. The splash guard 47 effectively closes the open end of drum 55 during the mixing operation. When the desired degree of mixing has been obtained, the carriage 42 is then raised by means of motor 53 and the screw 52 to its uppermost position as depicted in FIG. 1. The agitator 46 is withdrawn from the container 55 and liquid material permitted to drip into drum 55. When a majority of the dripping is completed, pan support 64 and an associated drip pan 65 is disposed beneath the agitator to receive any remaining material dripping therefrom. The container positioning means 38 then releases the container 55 and conveyor 32 moves the container to an appropriate curing and covering location. In the event a drip-receiving means or pan such as the pan 65 has received a sufficient quantity of hardenable material that it should be discarded, the pan 65 remains disposed generally beneath the agitator, the cylinder 101 is retraced releasing the pan, shaft 109 is retracted to tilt the support 64 as in the manner depicted by the dotted lines in FIG. 10 to cause the pan to slide from the support 64. The pan 65 then falls into a container disposed beneath the pan support 64. In order to replace the drip-receiving means or pan 65, an unused pan such as the pan 165 of FIGS. 16 and 17 is moved on conveyor assembly 71 toward the drip pan supply means 70 wherein the fork 79 is disposed in a first position generally remote from the agitator and at its uppermost position wherein the tines 81 and 82 are in alignment with the conveyor 71. As the pan approaches the fork 79, the conveyor 71 pushes the pan such as the pan 165 onto and between the tines 81 and 82 of the fork 79 in the manner as generally depicted in FIG. 18. The fork 79 is lowered by the action of the cable cylinder 77 to a level of about the pan support 64. Pan support 64 is in its extended position with the pan support table 93 in a generally horizontal position. The fork 79 and ways 74 and 76 pivot to place the fork 79 and pan over the bearing bars 62 and 63. The tinws 81 and 82 of the fork 79 are generally parallel to the bearing bars 62 and 63. The pan support 64 is retracted toward the fork 79 and the table 93 positioned between the tines in a manner depicted in FIG. 18. The locking cylinder 83 is retracted from engagement with the flanges equivalent to the flanges 168 of FIG. 17 and the locking means 101 of the table 93 engages the pan. The pan support means 64 is then positioned generally adjacent the agitator, effectively sliding a pan such as the pan 165 from the tines of the fork 79. The fork 79 is then moved from its second position over the bearing bars 62 and 63 to its first position wherein the tines 81 and 82 are generally parallel and below conveyor 71. The fork 79 is then raised by means of the cable cylinder 77 to a position where it can receive a second pan from the conveyor 71. Mixers in accordance with the present invention beneficially are actuated by hydraulic or pneumatic means when it is desired to handle flammable materials. It is preferred that the agitator drive be a pneumatic motor in that it may be operated in such a manner to provide some impact when it is desired to unscrew the draw bar such as the draw bar 189 of FIG. 19. If nonflammable materials are being handled, electrically driven linear actuators may be employed and pan locking cylinders such as 101 of FIGS. 9 and 10 and 83 of FIG. 2 and 126 of FIG. 12 may be replaced with spring-loaded solenoids. The drip-receiving means or drip pans are readily fabricated from sheet metal, however, resin-impregnated paper and plastics may also be employed if they are not attacked by material dripping from the agitator. Beneficially, operation of mixers in accordance with the invention is readily achieved remotely. The appropriate control valves in the case of hydraulic and pneumatic operation, or switches in the case of electrical operation, can be disposed in a control console at any desired distance from the mixer. In the event that the mixer is used by a person familiar with its operation, individual controls are very adequate; however, if the mixer is to be operated by persons who have a tendency to be forgetful, it is desirable to provide appropriate interlocks to prevent lowering the carriage 42 when the drip pan support 64 is disposed beneath the agitator and prevent extension of the agitator holding and positioning means when a drum 55 is in position between the positioners 38*a* and 38*b*, and to prevent interference between the positioning means 56 and the drip pan support means 64 when either one is in the extended position. The carriage 42 should not be lowered when the fork 79 is in the second position.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A mixing apparatus, the mixing apparatus having in cooperative combination a frame, a conveyor adapted to convey an open-topped container to receive resin and waste, a container positioning means adapted to locate an open-topped container at a predetermined location on the conveyor, an agitator assembly reciprocally mounted on the frame, the agitator assembly comprising agitator drive means, an agitator demountably affixed to the drive means, the agitator being selectively positionable so (1) that the agitator extends at least partially into a container held by the container-locating means, (2) that the agitator is external to the container means to connect and disconnect the agitator from the agitator drive means, a splash guard generally disposed about the agitator and adapted to cover a waste-receiving container when the agitator extends at least partially into a container, means to selectively position a replacement agitator adjacent the agitator drive means, a drip-receiving assembly, the drip-receiving assembly comprising a drip pan support means positionable beneath the agitator assembly when the agitator assembly is disposed externally to a container, the drip pan support means being adapted to carry a discardable drip-receiving member and to selectively discard the drip-receiving member into an open-topped container positioned by the container-positioning means and a means to repetitively supply discardable drip-receiving members to the pan supporting means.

2. The mixing apparatus for claim 1 wherein the splash guard comprises:

a first generally planar splash guard portion affixed to the agitator assembly, a second splash portion demountably affixed to the first generally planar portion, means to selectively connect and disconnect the first and second splash guard portions to thereby cause the second splash guard portion to fall into a waste-receiving container at the predetermined location on the conveyor.

3. The mixing apparatus of claim 1 wherein the drip-receiving assembly comprises:

a drip pan support attached to a drip pan positioning means adapted to selectively position the drip pan support at a first position beneath the agitator and above a container at the predetermined location on the conveyor and a second position remote from the first position.

4. The mixing apparatus of claim 3 wherein the drip pan support is pivotally attached to the drip pan positioner means and means to pivot the drip pan support to a position where a drip-receiving member supported thereon falls into a container at the predetermined location on the conveyor.

5. The mixing apparatus of claim 4 wherein the drip-receiving assembly has means adapted to carry a drip-receiving member and selectively discard the drip-receiving member into an open-topped container positioned by a container-positioning means.

6. The mixing assembly of claim 5 including means to selectively alter the vertical position of the means to repetitively supply when the drip pan support is in the second position.

7. The mixing assembly of claim 4 including a conveyor for drip-receiving means adapted to deliver drip-receiving means to the drip pan support when the drip pan support is in the second position.

8. The mixing assembly of claim 1 including generally vertical ways disposed on the frame, a carriage generally vertically mounted on the ways, the agitator assembly affixed to the carriage and a hood defined by said carriage, the hood generally surrounding the agitator on sides and top.

9. A mixing apparatus, the mixing apparatus having in cooperative combination a frame, a conveyor adapted to convey an open-topped waste-receiving container suitable to contain resin and radioactive waste, a container positioning means adapted to locate an open-topped container at a predetermined location on the conveyor, an agitator assembly reciprocally mounted on the frame, the agitator assembly comprising agitator drive means, an agitator demountably affixed to the drive means, the agitator being selectively positionable so that the agitator extends at least partially into a container held by the container-positioning means, a splash guard generally disposed about the agitator and adapted to cover a waste-receiving container when the agitator extends at least partially into a container, the splash guard comprising a first generally planar splash guard portion affixed to the agitator assembly, a second splash portion demountably affixed to the first generally planar portion, means to selectively connect and disconnect the first and second splash guard portions to thereby cause the second splash guard portion to fall into a waste-receiving container at the predetermined location on the conveyor, means to connect and disconnect the agitator from the agitator drive means, means to selectively position a replacement agitator adjacent the agitator drive means and connect said agitator to the drive means, a drip-receiving assembly, the drip-receiving assembly having a drip pan support means selectively positionable beneath the agitator assembly when the agitator assembly is disposed external to a container, the drip-receiving means being selectively positionable beneath the agitator assembly and remote therefrom, the drip-receiving assembly being adapted to carry a drip-receiving member and selectively discarding the drip-receiving member into an open-topped container positioned by a container-positioning means, the drip pan support being pivotally attached to the drip pan positioner means and means to pivot the drip pan support to a position where a drip-receiving member supported thereon falls into a container at the predetermined location on the conveyor, the means to supply a drip-receiving member being a generally horizontally-disposed fork having two tines, the fork pivotally supported remote from the tines, the tines being generally parallel and spaced apert to receive the drip pan support means therebetween when the drip pan support means is remote from the agitator, the fork being pivotable to at least two positions: (1) a first position for receiving a drip-receiving member and (2) a second position for delivering a drip-receiving means to the drip pan support means when the drip pan support means is remote from the agitator, and means to supply a drip-receiving member and position said drip-receiving member on said drip-receiving means.

10. The mixing assembly of claim 9 including means to selectively alter the vertical position of the means to supply when the fork is in the first position.

11. The mixing assembly of claim 9 including a conveyor for drip-receiving means adapted to deliver drip-receiving means to the fork when the fork is in the first position.

12. The mixing assembly of claim 9 including generally vertical ways disposed on the frame, a carriage generally vertically mounted on the ways, the agitator assembly affixed to the carriage and a hood defined by said carriage, the hood generally surrounding the agitator on sides and top.

* * * * *

Disclaimer and Dedication 4,647,213.—*Robert A. Hay, II*, Midland, Mich. WASTE DISPOSAL APPARATUS. Patent dated Mar. 3, 1987. Disclaimer and Dedication filed Dec. 18, 1989, by the assignee, The Dow Chemical Company.

Hereby disclaims and dedicates to the Public all claims of said patent.

[*Official Gazette April 10, 1990* ]